US005732664A

United States Patent [19]

Badeaux, Jr.

[11] Patent Number: 5,732,664

[45] Date of Patent: Mar. 31, 1998

[54] BOILER CONTROL SYSTEM

[76] Inventor: Joseph W. Badeaux, Jr., 25760 Winter St., Plaquemine, La. 70764

[21] Appl. No.: 697,899

[22] Filed: Aug. 30, 1996

[51] Int. Cl.[6] ..... F22B 33/00

[52] U.S. Cl. ..... 122/1 R; 122/31.1; 60/39.05; 60/667; 431/90

[58] Field of Search ..... 60/667, 39.05; 431/2, 4, 89, 90; 122/1 R, 446, 448.1, 31.1

[56] References Cited

U.S. PATENT DOCUMENTS

| | | | |
|---|---|---|---|
| 3,862,395 | 1/1975 | Eaton | 122/31 |
| 4,342,550 | 8/1982 | Tuck | 431/90 |
| 5,357,741 | 10/1994 | Talabisco et al. | 60/39.05 |
| 5,507,141 | 4/1996 | Stigsson | 60/39.05 |

*Primary Examiner*—Henry A. Bennett
*Assistant Examiner*—Jiping Lu
*Attorney, Agent, or Firm*—Reginald F. Roberts, Jr.

[57] ABSTRACT

Apparati and methods for controlling the distribution of steam to a number of boilers, and for optimizing the performance of a steam boiler. The distribution of steam to the boilers is controlled by a master control system in communication with the boilers, steam subheaders, steam-flow sensors, a comparator module, a summer module, a main steam-supply header, and a pressure sensor in the main steam-supply header. The performance of an individual boiler is optimized by (a) maintaining a constant steam pressure in the boiler, (b) measuring the relative humidity of the air supply for fuel combustion, and (c) supplying and controlling the amount of steam to be mixed with the air supply to optimize the combustion process.

7 Claims, 2 Drawing Sheets

BOILER CONTROL SYSTEM

BACKGROUND OF THE INVENTION

The present invention relates to steam control. More particularly, the invention relates to the control of steam distribution to a plurality of boilers, and to optimizing the performance of a steam boiler.

The technology for control of steam-generation systems has evolved by trial and error over the years, with very few scientific principles applied. Recently the use of BTU summing and oxygen-bias controls have led to increases in efficiency, along with improved burner designs and better metallurgy. However, the basic system has remained, for the most part, unchanged.

Burner management and combustion control are currently done by a system which comprises fuel-air lead-lag control, stack-oxygen measurement which biases combustion air flow, BTU summing of fuel values which is then used to ratio air-to-fuel control, and master pressure control which resets the fuel rate.

Most of the changes which have been made to boilers and fired heaters have come as a retrofit to existing equipment. This has precluded the examination of the total system in a scientific and analytical manner. When this is done, it can be seen that a reordering of priorities is desirable.

Much experimentation has been carried out in the area of burner and gun design, in order to promote atomization and mixing of fuels with combustion air to promote rapid and efficient burning of the fuel while reducing the amount of excess air required, in the quest of fuel efficiency and of reducing the size of the equipment. This work has resulted in the equipment in use today, but the equipment is quite susceptible to damage due to upset conditions or misoperation.

The present invention provides technology which solves many of the problems discussed above.

SUMMARY OF THE INVENTION

In general, the present invention in a first aspect provides a steam-distribution control system for a plurality of boilers. The control system comprises (a) a plurality of steam sub-headers; (b) a plurality of steam-flow sensors for sensing the flow of steam through the sub-headers; (c) means for summing the total flow of steam through the sub-headers; (d) a main steam-supply header; (e) a steam-flow sensor in the main steam-supply header, for measuring the total flow of steam to the sub-headers; (f) a comparator for relating the sum of the individual steam flows through the individual sub-headers to the total steam flow measured by the steam-flow sensor; (g) a master control system for overall control of steam distribution; (h) a pressure sensor in the main steam-supply header for measuring the pressure in the main steam-supply header; (i) means for sending a first signal from the pressure sensor in the main steam-supply header to the master control system and to the comparator module, the first signal indicating the pressure in the main steam-supply header; (j) means for sending a second signal from the steam-flow sensor in the main steam-supply header to the master control system, the second signal indicating the steam flow through the main steam-supply header; (k) a summer module to provide the means for summing the total flow of steam through the steam sub-headers; (l) means for sending a third signal from each steam-flow sensor in each steam sub-header to the summer module, the third signal indicating the steam flow through each steam sub-header; (m) means for sending a fourth signal from the summer module to the comparator module, the fourth signal indicating the total steam flow through the steam sub-headers; (n) means for sending a fifth signal from the comparator module to the master control system, the fifth signal indicating the magnitudes of the total measured flow of steam through the main steam-supply header and of the summation of the steam flows through each of the steam sub-headers; and (o) means for adjusting the amount of steam production to each boiler in accordance with elements (a) through (n).

In a second aspect the invention provides a steam boiler control system. The control system comprises (a) a steam back-pressure controller which maintains a constant steam pressure in the boiler; (b) means for measuring the relative humidity of the air supply for fuel combustion; and (c) means for supplying and controlling the amount of steam to be mixed with the air supply in order to optimize the combustion process.

In a third aspect the present invention provides a method for controlling the distribution of steam production to a plurality of boilers. The method comprises the steps of (a) providing a plurality of steam sub-headers; (b) measuring the rate of flow of the steam through each of the sub-headers; (c) providing a main steam-supply header; (d) measuring the rate of flow of the steam through the main steam-supply header; (e) summing the individual rates of steam flow through the individual sub-headers; (f) comparing the sum of the individual rates of steam flow through the individual sub-headers with the measured rate of steam flow through the main steam-supply header; (g) controlling the distribution of steam production to each boiler; (h) measuring the pressure in the main steam-supply header with a pressure sensor in the main steam-supply header; (i) providing a master control system for controlling the distribution of steam production to each boiler; (j) utilizing a comparator module for comparing the sum of the rates of steam flow through the sub-headers with the rate of steam flow through the main steam-supply header; (k) sending a first signal from the pressure sensor in the main steam-supply header to the master control system and to the comparator module, the first signal indicating the pressure in the main steam-supply header; (l) utilizing a steam-flow sensor in the main steam-supply header to measure the rate of steam flow through the main steam-supply header; (m) sending a second signal from the steam-flow sensor in the main steam-supply header to the master control system, the second signal indicating the steam flow through the main steam-supply header; (n) utilizing a summer module to sum the individual rates of steam flow through the individual sub-headers; (o) utilizing a steam-flow sensor in each sub-header to measure the flow of steam through each sub-header; (p) sending a third signal from each steam-flow sensor in each steam sub-header to the summer module, the third signal indicating the steam flow through each steam sub-header; (q) sending a fourth signal from the summer module in the comparator module, the fourth signal indicating the total steam flow through the steam sub-headers; (r) sending a fifth signal from the comparator module to the master control system, the fifth signal indicating the magnitudes of the total measured flow of steam through the main steam-supply header and of the summation of the steam flows through each of the steam sub-headers; and (s) regulating the flow of steam production to each boiler in accordance with steps (a) through (r).

In a fourth aspect the present invention provides a method for optimizing the performance of a steam boiler. The method comprises the steps of (a) maintaining a constant steam pressure in the boiler; (b) measuring the relative humidity of the air supply for fuel combustion; and (c) supplying and controlling the amount of steam to be mixed with the air supply to optimize the combustion process.

DETAILED DESCRIPTION OF THE INVENTION

The present invention controls the flows of air, fuel, and steam to a boiler or a plurality of boilers, and the flow of steam from the boiler or boilers.

Figure 1:
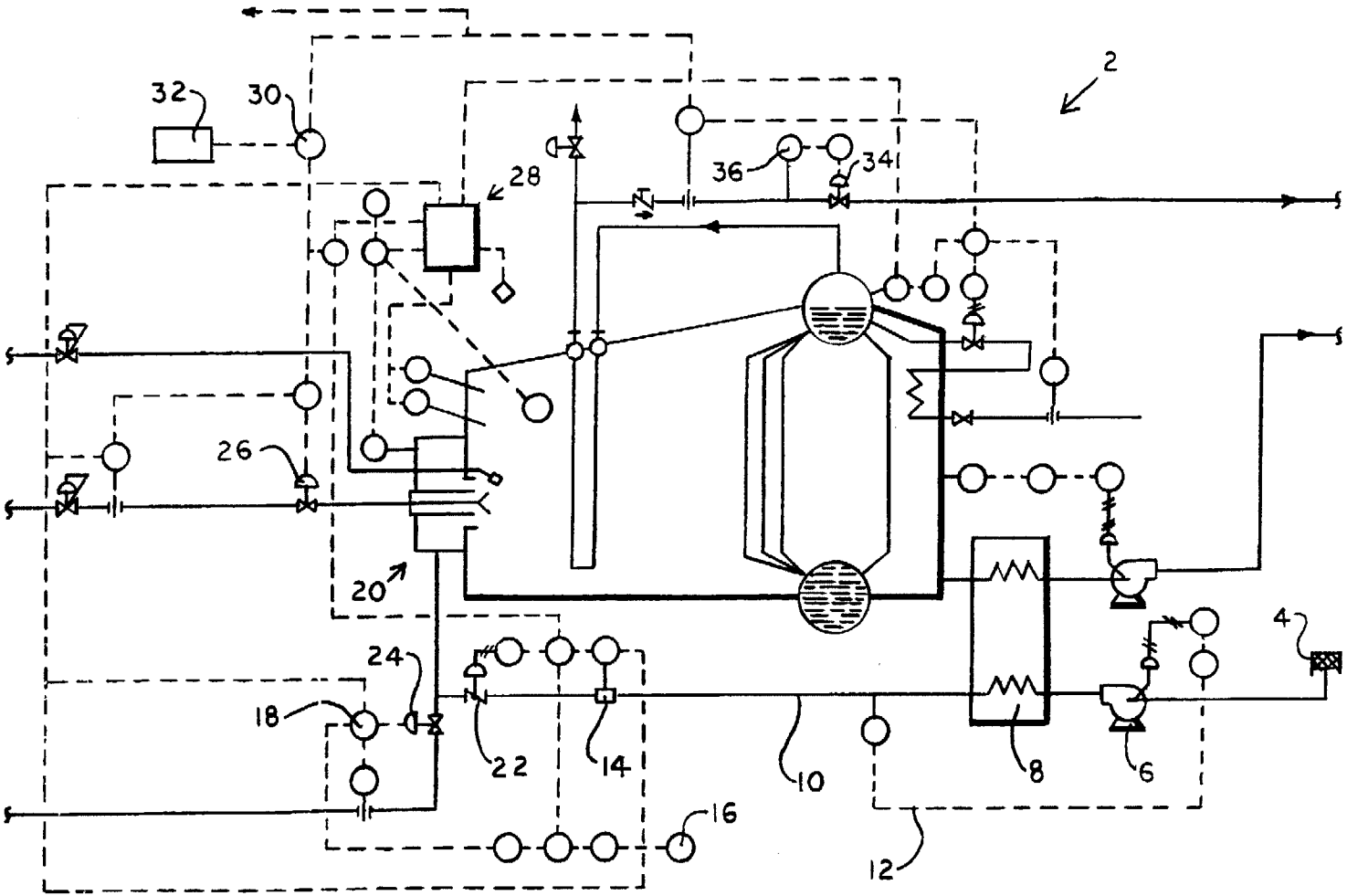
FIG. 1 is a schematic representation of a steam boiler, made in accordance with the principles of the present invention.

More specifically, reference is made to FIG. 1, in which is shown a schematic representation of a steam boiler, made in accordance with the principles of the present invention and generally designated by the numeral 2. Incoming air passes through an air filter 4 to the inlet of a forced-draft fan 6. The air then passes through the fan 6 outlet into an air heater 8, which is heated by flue gas from the boiler 2. The air pressure in an air duct 10 is controlled by a pressure controller 12, which resets the opening of the fan 6 inlet damper. The control of the air pressure enables an air-flow sensor 14 to operate much more accurately.

A relative-humidity sensor 16 is used to correct the air-flow measurement of the air-flow sensor 14, by subtracting the contribution of the water vapor in the air from the total air flow, thereby measuring the flow of air on a dry basis. The signal from the relative-humidity sensor 16 is also used to adjust the level of the water vapor in the air to the level desired for optimum combustion by resetting a first flow controller 18 which admits steam into the air duct 10. The mixture of air and steam then enters the burner area 20 of the boiler 2. The flow of air is controlled by a first flow-control valve 22, and the flow of steam by a second flow-control valve 24.

Incoming fuel is regulated by a third flow-control valve 26, and is fed to the burner area 20, where it admixes with the optimized steam-air mixture, and burns. The above-described control of the air and water vapor promotes enhanced burning, increased flame radiation, shorter flame bursts, and more nearly complete combustion.

There is a plethora of empirical evidence indicating that the presence or absence of water vapor in burner influent has a profound effect on the quality of combustion, as well as on the ratio of of the combustion products. Indeed, when No. 2 oil is atomized with air, a yellow flame with dark spots is produced, while atomization with steam gives a fine blue flame. The difference is not due to mechanical differences in the atomization of the fuel, but to the presence of the water vapor in the flame. It is also demonstrable that a natural gas flame in a conventional heater is shorter and of better quality during periods of high humidity.

The effect of hydrogen-to-carbon ration in a fuel on the quality of a flame is readily observable. The higher the hydrogen-to-carbon ratio, the better the fuel burns. Natural gas, methane, has a very high hydrogen-to-carbon ratio compared to most other fuels, and it burns quite cleanly. Olefins, diolefins, and acetylenes produce sooty flames, even when mixed with adequate amounts of air for combustion. When steam is added to the burner constituents, the soot disappears and even these fuels burn cleanly. Preferably, the hydrogen-to-carbon ratio is adjusted by steam addition if and as needed to from about three tenths to about five tenths.

Heat transfer in a furnace is effected by radiation and convection. The incandescent gases present in a furnace firebox radiate to the walls and tubes, and then transfer the rest of the contained heat by surface conduction to cooler areas of the unit. It is known that elemental gases such as nitrogen and oxygen cannot radiate, but that binary gases such as water, carbon dioxide, and carbon monoxide radiate heat very well. In the light of these observations, it can be postulated that the higher the ratio of binary to elemental gases in a flame, the greater the radiation of heat, which will result in a more rapid reduction of the temperature of the flame.

When boilers are equipped with preheat systems, the production of oxides of nitrogen is increased. This condition is usually controlled by the recirculation of the stack gas to the burner. The motivating theory is that the carbon dioxide present in the recycled gas reduces the flame temperature and lowers the production of nitrogen oxides by shifting the equilibrium of the reaction to the left. This theory is only partially correct. The rest of the phenomenon has to do with the fact that a certain amount of radiation from the flame is necessary, and that in the absence of a necessary number of binary-gas molecules to effect the required radiation, requirement for equilibrium in the flame will cause the formation of additional binary-gas molecules. Because of the larger amount of nitrogen present, oxides of nitrogen will be formed. When binary gases such as water and carbon dioxide are introduced, the requirement for radiation is satisfied, and excessive amounts of nitrogen oxides are not generated. It is the radiative capability of the water molecules which causes the reduction of soot in flames from the burning of olefins, acetylenes, and aromatic hydrocarbons, by the heating of carbon to temperatures which are sufficiently high to permit its combustion.

The principal problem in the control of combustion air flow to a furnace is caused by the changes in relative humidity in the local climate. Water vapor in atmospheric air can vary from a very low concentration to as much as six-and-one-half percent by volume at high ambient temperatures and humidities. Because such high levels of water vapor in the combustion air introduce errors in conventional air-flow measurement, the air-flow controller is generally biased by measuring the stack oxygen content, in order to maintain the necessary amount of excess air at the burner. Because the method generally used for this purpose is the depression of the measured value of air flow, in essence "lying" to the air-flow controller, the actual air flow cannot be known.

In order to control any chemical reaction, of which combustion is a specific example, it is desirable to control all of its aspects. The focus of burner management has traditionally been to provide a given amount of excess oxygen at the burner at all times, including normal steady operation, increasing rates, and decreasing rates. Otherwise, very little attention has been given to the chemistry of the burning of fuel. When the evidence suggesting that efficiency of burning is greatly enhanced by the hydrogen-to-carbon ratio in the flame, and the higher radiation rates observed in the presence of binary gases in the flame are considered, it can be concluded that control of relative humidity in the combustion air can only enhance the efficiency of burning and heat transfer in the furnace. This can beneficially be done, in accordance with the principles of the present invention, by the addition of low-pressure steam to the combustion air, in order to control the water content at the most efficient value. This value will vary from furnace to furnace, and will also depend on the fuel which is being fired. Control of steam addition can be determined by air-flow measurement coupled with humidity measurement, in order to control the amount of steam which is to be added to the combustion air. In this way, the amount of water vapor present in the combustion air can be absolutely controlled, and the amount of oxygen present can be calculated by the control system. Oxygen measurement in the stack can then be used to verify the flow-control scheme. The water-vapor content of the combustion air can then be adjusted to obtain optimum burning conditions, producing both maximum heat transfer and low emissions of nitrogen oxides.

A firing system 28 for the boiler 2 is reset by a second flow controller 30, which receives a signal from a master control system 32. The second flow controller 30 adjusts the proportions and amounts of air and fuel to regulate and control the quantity of steam generated by the boiler 2. Conventionally, a pressure controller is used to perform this function. However, pressure control is capable of overfiring a boiler. The use of a flow controller 30 prevents the master control system 32 from ovefiring the boiler 2 during periods of unstable steam distribution.

Steam produced by the boiler 2 leaves the boiler 2 by way of a control valve 34, which is reset by a pressure controller 36 in order to maintain the steam pressure in the boiler 2 constant under all firing conditions, thereby eliminating problems of drum (not shown) level control and steaming in the boiler 2 tubes (not shown).

Figure 2:
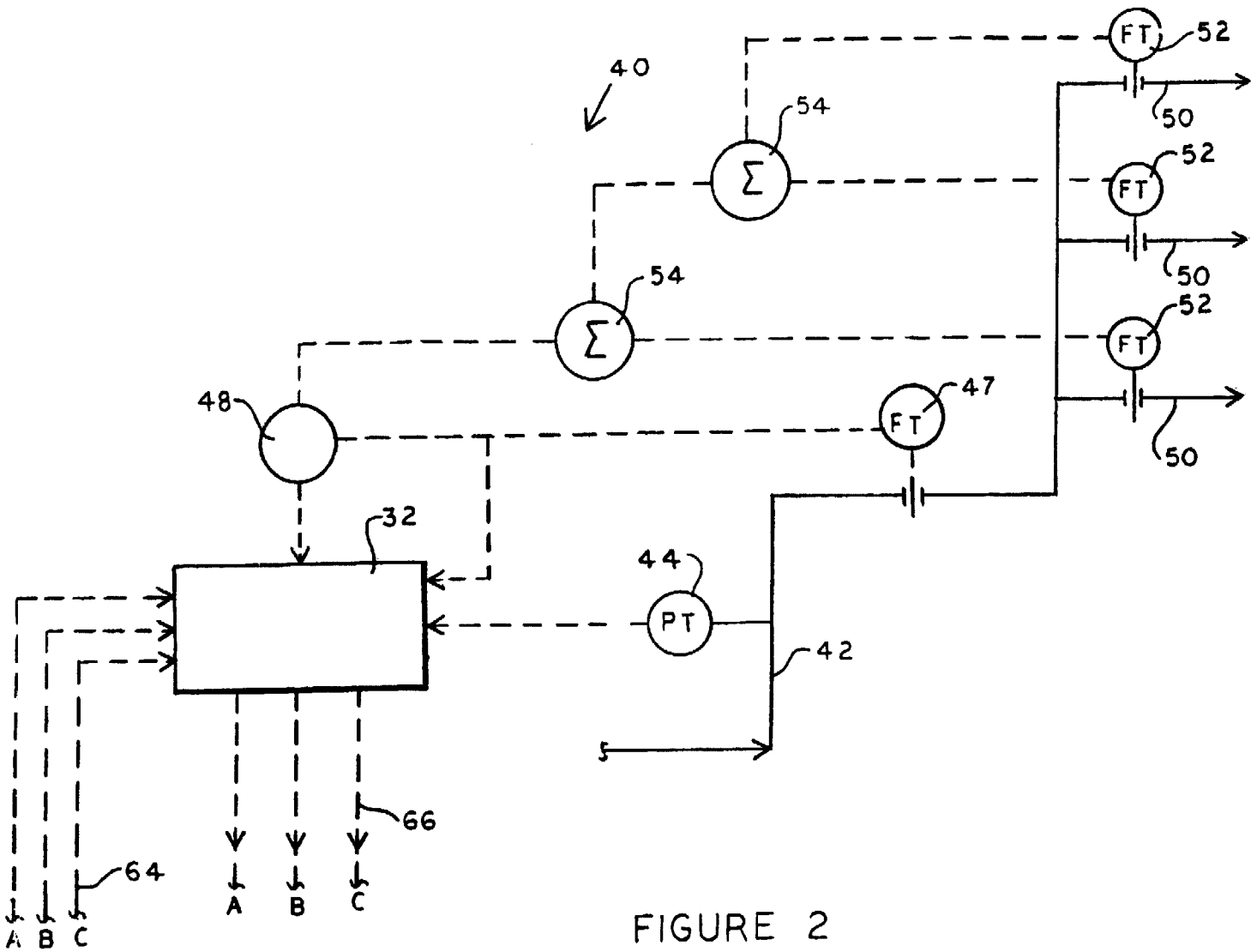
FIG. 2 is a schematic representation of a steam-distribution control system for a plurality of boilers, made in accordance with the principles of the present invention.

Reference is now made to FIG. 2, in which is shown a schematic representation of a steam-distribution control system for a plurality of boilers, made in accordance with the principles of the present invention and generally designated by the numeral 40.

Product steam from the individual boilers 2 enters a main steam supply header 42, where the steam-header pressure is measured by a pressure sensor 44, whose signal is sent to the master control system 32. A steam-flow sensor 47 measures the flow of steam passing through the main steam header 42, and whose output signal is sent to the master control system 32 and to a comparator module 48. Steam passes from the main steam header 42 and enters a plurality of steam sub-headers 50.

Each sub-header 50 is equipped with a steam-flow sensor 52, whose signal is sent to a summer module 54. The summer module 54 adds the flows through the sub-headers 50, and outputs to the comparator module 48 a signal equal to the total steam flow through the sub-headers 50. A signal from the comparator module 48 is sent to the master control system 32, indicating the magnitudes of the total measured flow of steam through the main steam sub-header 42 and of the summation of the steam flow through each of the sub-headers 50.

From each of the boilers 2 in the steam supply system a signal 64 is sent to the master control system 32, indicating the status of a given boiler 2, as to whether the boiler 2 is producing steam or is off-line. From the master control system 32 a flow signal 66 is sent to each master control system 32 flow controller 30, which raises or lowers the production of steam demand for each boiler 2 as required. In order to regulate the boilers 2 to properly and efficiently meet the demand of the steam-distribution control system 40, the master control system 32 considers the pressure sensor 44 signal, the flow sensor 47 signal, and the comparator module 48 signal. A logic scheme in the master control system 32 raises or lowers the output signals 66 as needed, based on the status inputs from the summer module 54 signal as well as on a signal input 18 from a human operator (not shown).

Because the sum of the steam flows in the sub-headers 50 is constantly being compared by the comparator module 48 to the steam flow through the main steam header 42 and the flow sensor 47, the master control system 32 is able to anticipate an increase or decrease in steam demand, and in response thereto make flow corrections in a timely manner before steam-system conditions are disturbed.

I claim:

1. A control system for a steam boiler equipped with an air supply and a fuel supply for a combustion process to generate steam for the boiler, the control system comprising:

(a) a steam back-pressure control system which maintains a constant steam pressure in the boiler;

(b) means for measuring relative humidity of the air supply and thereby determining contribution of water vapor in the air to total air flow for fuel combustion; and (c) means for supplying and controlling amount of steam for admixture with the air supply, for opimizing the combustion process;

the means for measuring the relative humidity of the air supply providing necessary data for determining the amount of steam for admixture with the air supply to optimize the combustion process which generates steam to be maintained at a constant pressure in the boiler by the steam back-pressure controls.

2. The steam boiler control system of claim 1, wherein the means for supplying and controlling the amount of steam for admixture with the air supply is provided by subtracting the contribution of the water vapor in the air from the total air flow, thereby measuring the flow of air on a dry basis.

3. The steam boiler control system of claim 1, wherein:

(d) the means for measuring the relative humidity of the air supply include a relative-humidity sensor;

(e) the relative-humidity sensor is used to correct for the relative humidity of the air supply by subtracting the contribution of the water vapor in the air from the total air flow, thereby measuring the flow of air on a dry basis;

(f) the means for supplying and controlling the amount of steam to be mixed with the air supply include (g) an air duct;

(h) an air-flow sensor;

(i) a flow controller for admitting steam into the air duct;

(j) a first flow-control valve for controlling the air flow;

(k) a second flow-control valve for controlling the steam flow; and (l) means for sending a signal from the relative-humidity sensor to the flow controller, the signal causing the flow controller to adjust the contribution of the water vapor in the air as required for optimum combustion by resetting the flow controller.

4. The steam boiler control system of claim 1, wherein the combustion process is optimized in accordance with ratio of hydrogen to carbon in the mixture of fuel and steam, and wherein the hydrogen-to-carbon ratio is adjusted by steam addition as needed to from about three tenths to about five tenths.

5. A method for optimizing the performance of a steam boiler equipped with an air supply and a fuel supply for a combustion process to generate steam for the boiler, the method comprising the steps of:

(a) providing a steam back-pressure control system for maintaining a constant steam pressure in the boiler;

(b) measuring relative humidity of the air supply and thereby determining contribution of water vapor in the air to total air flow for fuel combustion; and (c) supplying and controlling amount of steam to be mixed with the air supply to optimize the combustion process.

6. The method of claim 5, wherein supplying and controlling the amount of steam to be mixed with the air supply is effected by subtracting the contribution of the water vapor in the air from the total air flow, thereby measuring the flow of air on a dry basis.

7. The method of claim 5, wherein:

(d) the relative humidity of the air supply is measured by a relative-humidity sensor;

(e) the relative-humidity sensor is used to correct for the relative humidity of the air supply by subtracting the contribution of the water vapor in the air from the total air flow, thereby measuring the flow of air on a dry basis;

(f) supplying and controlling the amount of steam to be mixed with the air supply is effected by (g) providing an air duct;

(h) providing an air-flow sensor;

(i) providing a flow controller for admitting steam into the air duct;

(j) utilizing a first flow-control valve to control the air flow;

(k) utilizing a second flow-control valve to control the steam flow; and (l) sending a signal from the relative-humidity sensor to the flow controller, to cause the flow controller to adjust the contribution of the water vapor in the air as required for optimum combustion by resetting the flow controller.

* * * * *